United States Patent [19]

Schramm

[11] 4,328,748

[45] May 11, 1982

[54] ARRANGEMENT FOR METERING INK ON THE FOUNTAIN ROLLER OF A PRINTING PRESS

[75] Inventor: Peter Schramm, Berliner Platz, Fed. Rep. of Germany

[73] Assignee: M.A.N.-Roland Druckmaschinen Aktiengesellschaft, Fed. Rep. of Germany

[21] Appl. No.: 228,877

[22] Filed: Jan. 22, 1981

Related U.S. Application Data

[63] Continuation-in-part of Ser. No. 219,042, Dec. 22, 1980, abandoned.

[30] Foreign Application Priority Data

Dec. 21, 1979 [DE] Fed. Rep. of Germany ..... 2951653

[51] Int. Cl.[3] ..... B41F 31/04; B41F 31/06

[52] U.S. Cl. ..... 101/365; 101/DIG. 26

[58] Field of Search ..... 101/DIG. 26, 365, 363, 101/364, 206, 207, 208, 209, 210, 148; 118/261

[56] References Cited

U.S. PATENT DOCUMENTS

| | | | |
|---|---|---|---|
| 1,275,348 | 8/1918 | Wood | 101/365 |
| 3,110,254 | 11/1963 | Davis | 101/365 |
| 3,968,746 | 7/1979 | Gaillochet | 101/365 |
| 4,193,345 | 3/1980 | Schoneberger et al. | 101/365 |

*Primary Examiner*—J. Reed Fisher

*Attorney, Agent, or Firm*—Leydig, Voit, Osann, Mayer & Holt, Ltd.

[57] ABSTRACT

An ink fountain of the type having a plurality of metering blades arranged closely side-by-side and having a metering edge which is presented to the fountain roller. The metering blades are divided into small groups of equal size with each group being supported upon a moveable carrier. A set of stops are interposed between each blade and its carrier to define (a) an extended reference position in which the presented edges of the blades on the carrier are in alignment and (b) a relatively retracted feeding position in which the blade is retracted a predetermined amount to define a gap for feeding of ink in the zonal position controlled by the blade. Each blade has a spring for biasing it forceably into its extended position; an individual power actuator is interposed between each blade and its carrier for retraction of the blade into its feeding position. A control device is provided for activating the actuators for periods of time which correspond to the ink requirements of the zonal position including provision for ensuring that at all times at least one of the metering blades in each group occupies its extended reference position. A biasing spring interposed between the frame of the fountain and each carrier urges the carrier in the direction of the fountain roller so that the extended blade thereon acts as a local gauging device for the retracted ones of of the blades in the group.

6 Claims, 6 Drawing Figures

FIG. 1
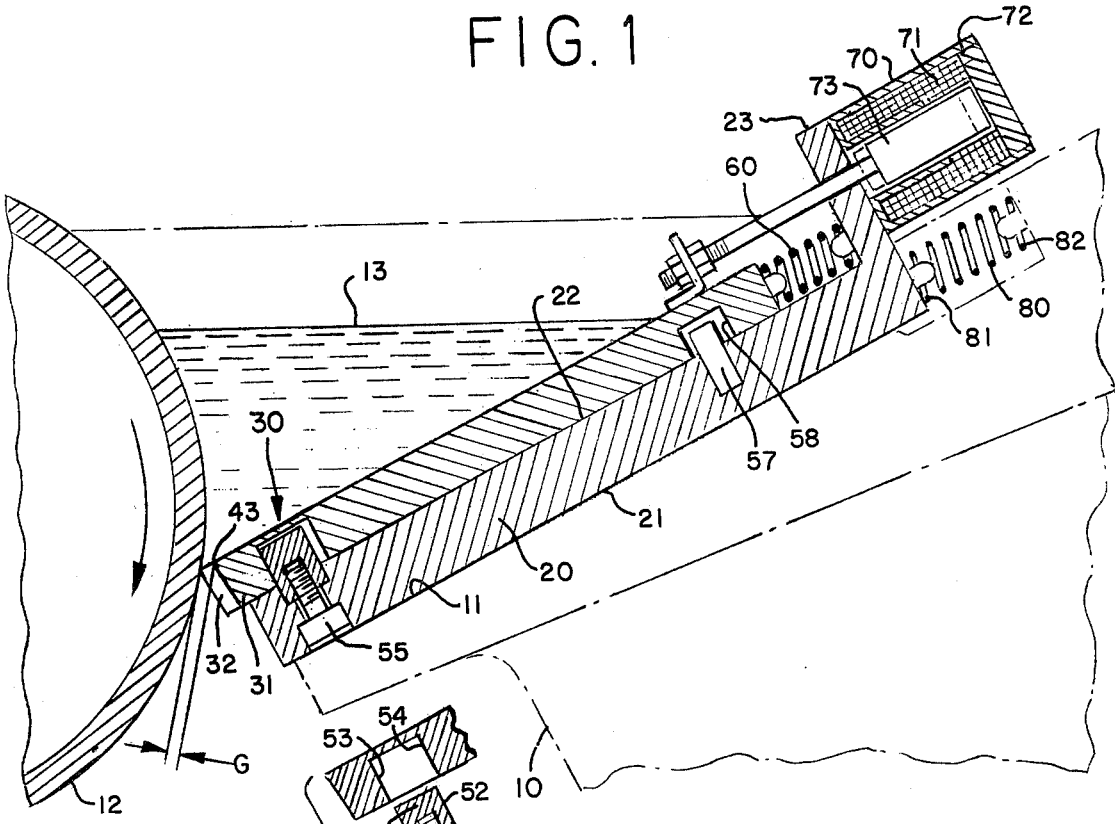
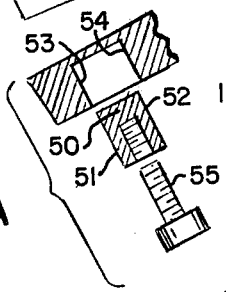
FIG. 1A
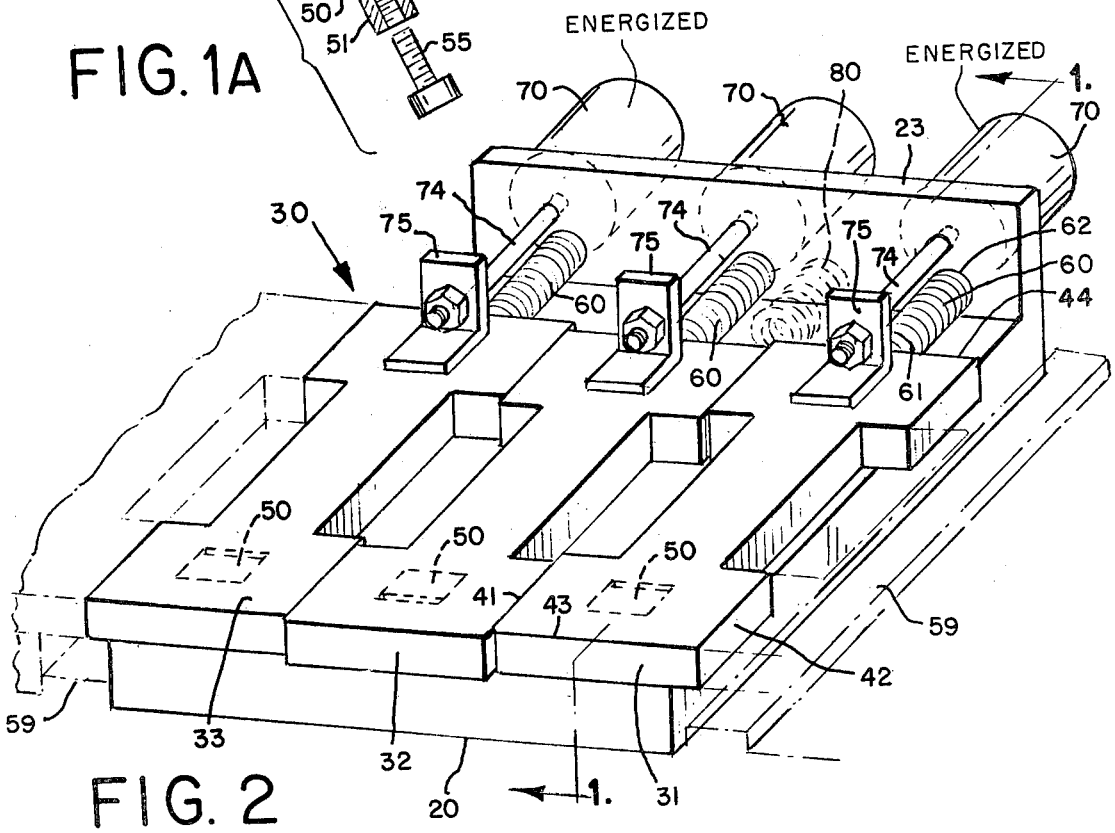
FIG. 2

FIG. 3
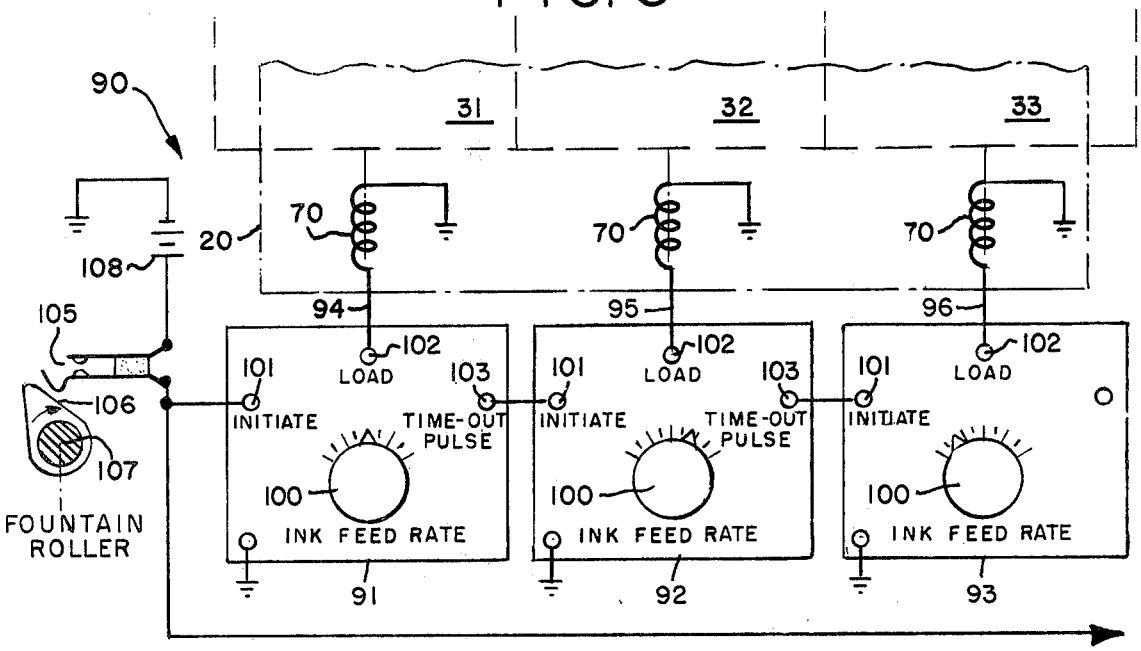
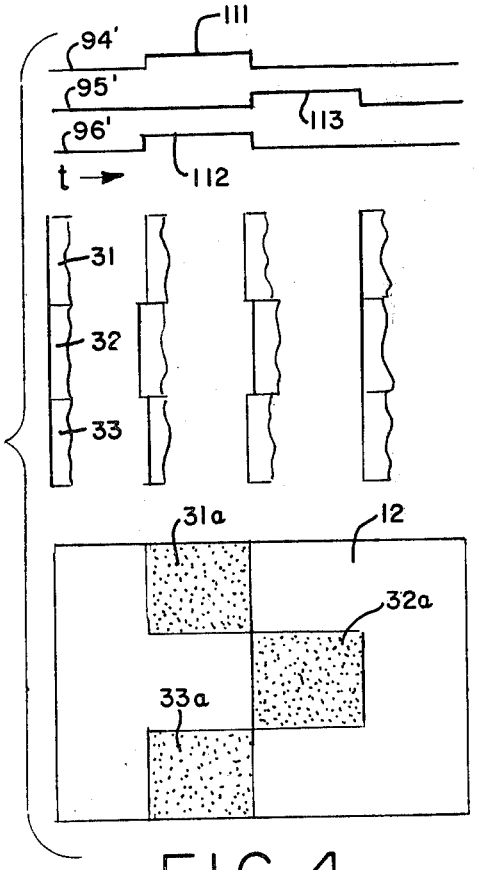
FIG. 4
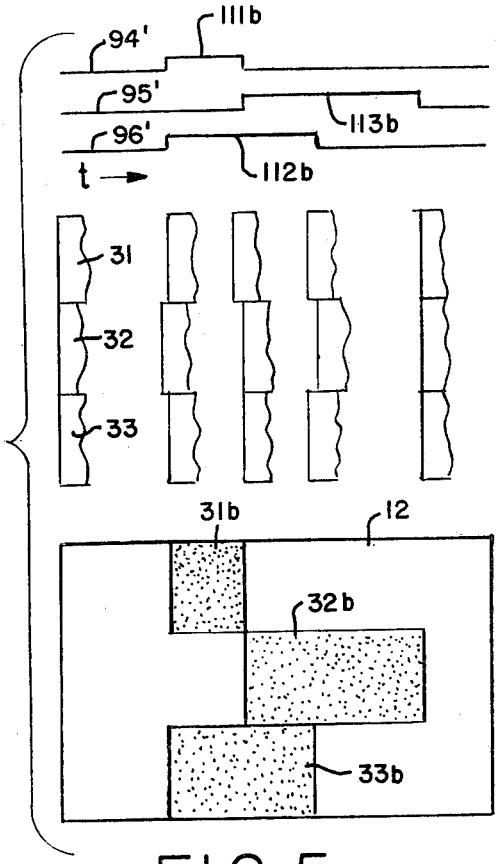
FIG. 5

ARRANGEMENT FOR METERING INK ON THE FOUNTAIN ROLLER OF A PRINTING PRESS

This is a continuation-in-part of application Ser. No. 219,042 filed Dec. 22, 1980, now abandoned.

In a printing press of either the lithographic type or letter press type there is often variation between the density of the images in the column, or zonal, positions. For example, one or more of the columns may have pictures with a dense background, or artwork requiring heavy pigmentation. It has been common to use a continuous metering blade in an ink fountain with adjusting screws spaced along the edges of the blade to vary the width of the gap through which the ink is fed in the various zonal positions.

In an alternative form of ink metering device the blade is divided into individually moveable sections which are spaced closely to one another and adjusted endwise by either manual or automatic means. For example there is shown in German document DE-PS No. 2530 109 an automatic control arrangement for reciprocating each metering element on a timed basis to control the average amount of ink fed in each zonal position over a predetermined time interval.

The disadvantage of this arrangement is that the width of the metering gap may be altered by wear over the course of time, requiring replacement of the metering elements or, at the least, frequent recalibration. In addition the accuracy is open to question because of undefined bending (bowing) stress in the fountain roller and other factors which affect the geometry of the device.

An ink metering device intended to ensure reproducibility of the thickness of the ink film produced at the fountain is disclosed in German document DE-AS No. 2628 098. In such construction each zone-wide metering element has an adjacent supporting element which remains in constant contact with the fountain roller for gauging purposes. One difficulty with such an arrangement is that no ink is spread from the fountain in the regions of the supporting elements. Reliance is placed upon the reciprocating or "vibrating" rollers in the inking system to bridge these ink-free zones, but even so it is difficult to achieve an ink film of uniformly progressive thickness on the form rollers which apply the ink to the plate.

It is, accordingly, an object to provide an ink metering arrangement in an ink fountain which permits highly accurate metering of ink in each zonal position. It is a related object to provide an ink fountain in which the accuracy of the metering is substantially unaffected by wear in the metering elements occuring over a period of time and unaffected by variations in geometry along the length of the fountain roller as may be due, for example, to slight bowing of the fountain roller resulting from the lateral pressure of the ink being fed through the metering gap.

Thus it is an object to provide a metering device in which the metering elements are arranged in small groups, each group being mounted upon a moveable carrier, and with at least one blade in each group serving, at any given time, as a local gauging device for the remaining ones of the blades in the group. More specifically it is an object to provide a set of stops interposed between each blade and its carrier defining ink-feeding and non-feeding blade positions, with control means for determining the length of the time interval that the blade is in contact with each of the stops and with provision for ensuring that at least one blade in each group is in its extended, non-feeding position so that such blade acts as a gauging device for the blades which are actively feeding ink.

It is a related object to not only provide means for acurately feeding ink according to the requirements of each zonal position but in which ink is fed at each point along the axis of the fountain roller free of the interruptions which characterize certain prior art devices in which feeding of ink is also timingly controlled.

It is a general object of the invention to provide an ink fountain in which the average amount of ink fed per unit of time in each of the zonal positions may be accurately and conveniently controlled, in which each metering element has a local gauging device which is unaffected by wear or geometrical variations occuring along the length of the fountain roller and which is, at the same time, of simple, economical construction, easily adjusted and used by an operator with only limited training and experience and which is capable of operating reliably over long periods of time without maintenance or down time.

Other objects and advantages of the invention will become apparent upon reading the attached detailed description and upon reference to the drawings which:

FIG. 1 is a vertical section, partly diagrammatic, showing an ink fountain constructed in accordance with the present invention as viewed along line 1—1 in FIG. 2;

FIG. 1*a* is an exploded fragmentary view for the purpose of identifying the stop surfaces;

FIG. 2 is an isometric view showing a group of three metering elements, or blades, mounted on the same carrier, each metering element having a power actuator;

FIG. 3 shows a rudimentary control circuit for producing control pulses for the actuators in FIG. 2;

FIG. 4. is a diagram showing an alternative mode of energization with equal amounts of ink being fed per cycle in each of the three zonal positions;

FIG. 5 is a diagram similar to FIG. 4 but with the control signals adjusted to accommodate different ink requirements in the zonal positions.

While the invention has been described in connection with certain preferred embodiments of the invention, it will be understood that I do not intend to be limited to such embodiments but intend, on the contrary, to cover the various alternative and equivalent forms of the invention included within the spirit and scope of the appended claims.

Turning now to FIG. 1 of the drawings there is disclosed a fountain having a frame 10 with a flat carrier-supporting surface 11 thereon. Extending the length of the frame is a fountain roller 12 which is slowly driven, in the usual fashion, in the direction of the arrow. The trough between the frame and the fountain roller contains a body of ink 13 which is fed through a gap G to develop a relatively thick film on the fountain roller as it rotates. The means for picking off the film and for smoothing and distributing it for application by a form roller to the plate on the plate cylinder will be understood to be conventional and need not be shown or described.

In accordance with the present invention the fountain roller includes a plurality of carriers arranged side-by-side on the frame having a blade-supporting surface and moveable perpendicularly to the roller. A plurality of metering blades are mounted in groups upon the respective carriers. A set of stops interposed between each blade and its carrier, define, for each blade, (a) an extended reference position and (b) a relatively retracted feeding position in which the blade defines a gap for feeding of ink in the particular zonal position. Means including a power actuator interposed between each blade and its carrier forceably moves the blade between its alternate positions in response to a timed control signal, with provision for ensuring that at all times at least one of the metering blades in each group occupies its extended reference position. Each carrier is biased to keep the extended blade on the carrier in contact with the fountain roller to act as a local gauging device for the retracted ones of the blades in the group.

Thus I provide, on the surface 11 of the frame a plurality of carriers 20 in the form of rectangular plates, preferably of metal, spaced side-by-side. Each plate 20 has a flat bottom surface 21 and an upper blade supporting surface 22, all of the upper surfaces of the respective carriers lying in a common plane. Extending along the rear edge of the plate is a flange 23 for the purpose of supporting the actuators to be discussed.

For defining the ink feeding gap G, and zonal variations therealong, a plurality of metering blades 30 are provided, each blade being of rectangular shape and arranged closely side-by side with respect to the adjacent blades. The metering blades are divided into small groups of equal number with each group being supported on a single one of the carriers. In the present instance the group consists of three blades 31, 32 and 33 (FIG. 2), all mounted on the supporting surface 22 of the carrier 20. Taking the blade 31 as typical, it has lateral edges 41, 42, the front end terminating in a presented metering edge 43.

Each of the metering blades has a set of fixed stops for the purpose of limiting movement in alternate directions with respect to the carrier. In the case of the blade 31 the stop element is in the form of a block of metal 50 having stop surfaces 51, 52 (FIG. 1*a*). The blade is hollowed out to provide cooperating stop surfaces 53, 54. The stop member 50 is anchored to the carrier 20 by means of a machine screw 55. The spacing between the stop surfaces 51, 52 is less than the spacing between the cooperating stop surfaces 53, 54 by an amount corresponding to the width of the ink feeding gap G. This is true of all of the metering blades.

The stop defines two positions for each of the metering blades with respect to its carrier, first, an extended reference position in which the presented edges of the blades on the carrier are all in alignment and, secondly, a relatively retracted feeding position in which the blade is retracted a predetermined amount to define a gap for feeding of ink in the zonal position controlled by the blade. With the stops 52, 54 in contact the blade occupies its retracted, feeding, position as illustrated in FIG. 1, whereas when the stop surfaces 52, 54 are in engagement the blade occupies its extended reference position which is the position occupied by the blade 32 in FIG. 2.

For the purpose of guiding the rear end of each metering blade along the same line of action as the front end, a dowel 57 is mounted in the carrier registering with a short longitudinal groove 58 formed in the underside of the blade. Since the blades are in close side-by side engagement, each blade tends to support the adjacent blades for movement parallel to one another in a direction perpendicular to the axis of the fountain roller. And since the direction of movement of the carriers is determined by the interengaging elements 50, 57 no special means need be provided for longitudinally guiding the carriers. If desired, however, they may be guided by ridges 59 (FIG. 2) in the frame, but if such ridges are used there should be a certain amount of lateral play so that accumulation of tolerances does not prevent engagement of blades mounted in end position on adjacent carriers. Alternatively, a small amount of lateral play may be provided at the stops 50 and at dowels 57.

In accordance with the invention each blade has a spring, which is interposed between the blade and the carrier, for biasing it forceably into its extended position. Taking the spring 60 which is associated with the metering blade 31, as representative, it has a first end 61 which bears against the rear surface 44 of the blade and a second end 62 which bears against the flange 23 on the carrier. The effect of the spring is to keep the surface 54 of the blade forceably biased against the surface 52 of the stop member which, as stated, defines the extended position of the blade.

In carrying out the present invention a power actuator of the thrusting type is provided between each metering blade and its carrier for moving the carrier against the force of bias to its alternate position, in the present instance, the retracted position. The power actuator, indicated at 70, is preferably of the electromagnetic type having a winding 71 surrounded by a hollow annular stator 72 of magnetic material which cooperates with an armature 73. The armature has a plunger 74, the presented end of which is anchored in a bracket 75 secured to the rear end of the associated metering blade. Thus when the winding is energized the armature is sucked inwardly causing the blade to be snapped against stop surface 51, the condition which has been illustrated in FIG. 1. The adjacent solenoid 70, associated with the metering blade 32, is, however, deenergized causing such blade to occupy its extended position (see also FIG. 2).

In accordance with one of the important aspects of the present invention a carrier biasing spring is interposed between the frame of the fountain and the carrier 20. Such biasing spring, indicated at 80 seats against the carrier at its front end 81 and against the frame 10 at its rear end 82. The carrier spring acts to urge the carrier in the direction of the fountain roller thereby to keep the extended blade, or blades, on each carrier, as for example the blade 32, in contact with the fountain roller to act as a local gauging device for the retracted ones of the blades in the group. Thus referring to FIG. 1 it will be noted that the extended blade 32, the presented edge of which is biased against the fountain roller by the carrier biasing spring 80, serves as an accurate local gauging device to determine precisely the thickness of the ink film produced at the gap G.

Control means are provided for the magnetic power actuators 70 for activating the actuators for periods of time which correspond to the ink requirements of the zonal position, the control means including provision for ensuring that at least one of the actuators in each group is activated in sequence so that at all times at least one of the metering blades in each group occupies its extended reference position. In short, each blade serves not only to feed ink over a timed interval but serves, outside of such interval, as a gauging device for the actively feeding blade, or blades, in the group.

While the control means may take many different forms without departing from the present invention, a typical and simplified control arrangement has been illustrated at 90 in FIG. 3. The control arrangement, for controlling the "on" times of the blades 31, 32 and 33, includes a set of three timers 91, 92 and 93 having output lines 94, 95 and 96. Each timer is of the type having an "initiate" terminal which, upon being pulsed, energizes the load circuit and maintains the load turned on over the desired, adjustable time interval. When the timer "times out" the load is turned off and a time-out pulse is produced to initiate a subsequent timer in the series.

Thus taking the timer 91 as representative, it includes a time adjusting knob 100, and an "initiate" terminal 101, a load terminal 102 and a "time-out" pulse terminal 103.

In the particular arrangement illustrated in FIG. 3 the timers are effectively connected in series and means are provided for periodically initiating the first timer in such series. This is conveniently done by a swith 105 closed momentarily by a cam 106 on a shaft 107 coupled to the fountain roller. A source of current 108 is included in the initiating circuit.

In operation, when the fountain roller reaches a reference position in the feeding cycle the switch 105 is closed which immediately energizes the output line 94 of the first timer to retract the metering blade 31 so that it begins to feed. Such feeding continues for an interval set by the knob 100, and when the interval is "timed-out" the line 94 feeding the associated solenoid 70 is de-energized permitting the blade 31 to snap to its extended position under the urging of its biasing spring 60, so that the blade 31, instead of feeding ink, becomes a gauging device for the adjacent blade 32. At this time a pulse is produced at terminal 103 of the timer 91, initiating operation of the timer 92 for an interval set on the knob 100 and which corresponds to the demand for ink in the particular zonal position. When the second time interval "times-out," the line 95 and its associated solenoid 70 are de-energized, permitting the blade 32 to be restored to its extended position, the third timer 93 is initiated to energize the line 96, activating the third blade 33, which then becomes the feeding blade, with both of the blades 31, 32 serving in a gauging capacity. When the third timer "times-out" no further feeding takes place until the fountain roller again rotates around to its reference, or initiating, position, whereupon the cycle is repeated.

While the ink is spread in each zonal position in the form of a relatively thick film of the same predetermined thickness, of a predetermined length, and which is discontinuous, peripheral continuity is quickly established by the ink rollers which are interposed between the output of the fountain roller and the plate on the plate cylinder. When it is desired to increase or decrease the rate at which ink is spread in each of the zonal positions, corresponding to the column positions on the printed image, the control knob of the corresponding timer is simply advanced or retarded to change the length of the strip of ink which is deposited, in such position, upon the fountain roller.

In the operation of the control circuit in FIG. 3 as connected, and as discussed, ink is fed by only one blade at a time in each group. In order to increase the total ink feed capacity of the fountain for a given thickness of ink film deposited upon the fountain roller (gap G), it is desirable to modify the control circuit to produce pulses as set forth in FIG. 4. Here the control signals, indicated at 94', 95' and 96', appear on lines 94, 95 and 96 in FIG. 3. This pattern of control signals can be produced by connecting the "initiate" terminal 101 of timer 93, instead of to terminal 103 of the preceeding timer, directly to the switch 105.

Under such circumstances (FIG. 4) pulses 111, 112 will be produced causing the first and third blades to move simultaneously into feeding position to lay strips of ink 31*a*, 33*a* on the surface of the fountain roller 12, with the remaining blade serving as a gauge. When the first timer "times-out," pulse 113 is produced by the second timer to move the second blade 32 into feeding position depositing the strip of ink 32*a*, with both of the blades 31, 33 performing a gauging function. Following "time-out" of the second timer, all three blades are restored to extended position awaiting the next impulse from switch 105.

Where the ink demand in the zonal, or column, positions differs, appropriate adjustment can be made by simply changing the length of the energizing pulses as set forth in FIG. 5. Here the pulse 111*b*, which controls blade 31, has been shortened producing an appropriately shorter patch of strip of ink, indicated at 31*b*, upon the fountain roller. The pulse 112*b*, which controls the metering blade 33 does not cut off at the same point as the pulse 111*b*, producing a correspondingly elongated strip of ink 33*b* on the fountain roller. When the blade 31 is released at the end of pulse 111*b*, pulse 113 immediately begins so that ink is spread simultaneously by blades 32, 33, with the released blade 31 serving in a gauging capacity. Finally, to define the end of the cycle, the pulse 113*b* terminates resulting in a patch, or strip, of ink 32*b* on the fountain roller, the entire cycle being endlessly repeated.

One of the main advantages of feeding ink from the fountain in a relatively thick film of adjustable length is that the timing and hence the length of the ink strips, may be precisely controlled over wide limits by the simple expedient of changing the length of the interval, and the problem of "pinched flow" encountered in more conventional ink fountains does not exist. This problem occurs when it is necessary to adjust the gap down to small values where the ink flow demanded in a given zonal position is very low. Where a gap is extremely small it is not only difficult to control the precise amount of ink being fed but the gap tends to be clogged by any foreign matter including ink skin, dirt, or paper fibers which may work their way reversely through the inking system. Because of the use of a large gap G of constant thickness, ink flows through at a high rate, as long as the gap is open, flushing along with it any foreign matter which might result in an incipient clogging condition. Moreover the rapid reciprocating movement of the blade as it snaps between the stops tends to dislodge any fibrous or other particles which might tend to cling to the metering edge.

While the invention has been described in connection with a group, or set, of three ink metering blades mounted upon the same carrier, it will be understood that the invention is not limited thereto. For example a group may consist of two blades which are alternatively actuated by a timing system of the type set forth in FIG. 3, the blades serving alternately for feeding and gauging. In short, the blades gauge one another as long as any feeding occurs, and, following the feed cycle, both blades are restored to their extended, ink cut-off condition.

As a further possibility a total of four blades may be grouped on one carrier, either controlled by the type of timing circuit illustrated in FIG. 3 or by an alternative circuit of the type described in connection with FIGS. 4 and 5 and in which a fourth timer is initiated in unison with the second timer. While use of as many as five blades supported by a single carrier is theoretically possible, it has been found that two, three or four are a more practical number and enable a higher degree of gauging accuracy.

One of the problems with similar feeding devices in the prior art is that wear inevitably occurs at the metering tips of the blades after a certain period of time requiring that the blades be replaced, re-machined, or at least recalibrated. The present construction has the advantage that wear, even that occuring over a long period of time, has very little effect upon the feed rate. The reason for this is that the blades, being formed of similar material, and operating in the same environment, tend to wear away at about the same rate. Thus, while a feeding blade may be worn away, the adjacent blade which serves as a temporary gauging device, compensates for this by being equally worn so that the width of the gap G, through which the ink is fed, remains substantially unaffected.

In the design of a practical device it is desirable to exercise a certain amount of care in the selection of the spring rates for the springs 60, 80. The spring 80 should be so chosen that a relatively light force is exerted between the metering edge of the blade and the surface of the fountain roller thereby to minimize wear on both of them. However the springs 60 should preferably be rather stiff to ensure positive engagement at the stop surfaces 52, 54 when the associated actuator 70 is de-energized; the reaction force of each spring 60 should, however, be sufficiently low as to be readily overcome by the associated actuator so that the stops 51, 53 are engaged with equal decisiveness.

It will be apparent that the objects of the invention have been amply fulfilled: Ink is fed accurately over a wide and adjustable range of feed rate while maintaining a gap of constant dimension. The rate of feed is substantially unaffected by wear or by the slight bowing of the fountain roller in contrast to more conventional fountains which do not have the localized gauging feature. Unlike certain prior art structures, ink is fed continuously over the axial length of the fountain roller without axial gaps or interruptions. The construction is simple and economical and may be successfully operated by personnel having only limited skill or experience.

I claim as my invention:

1. An ink fountain comprising, in combination, a frame, a fountain roller journaled with respect to the frame and extending the length thereof, drive means for slowly rotating the fountain roller, a plurality of carriers arranged side-by-side on the frame movable perpendicularly to the roller to define a blade-supporting surface, a plurality of metering blades on the blade-supporting surface arranged closely side-by-side to define zonal positions, each of the blades having a metering edge which is presented to the fountain roller, a body of ink above the metering blades and contained by the fountain roller, the metering blades being divided into small groups with each group being supported on a single one of the carriers, a set of stops interposed between each blade and its carrier, the stops defining (a) an extended reference position in which the presented edges of the blades on the carrier are in alignment and (b) a relatively retracted feeding position in which the blade is retracted a predetermined amount to define a gap for feeding of ink in the zonal position controlled by the blade, means including an individual power actuator interposed between each blade and its carrier for forceably moving the blade between its alternate positions, control means for activating the actuators for periods of time which correspond to the ink requirements of the zonal position, the control means including provision for ensuring that at least one of the actuators in each group is operated in sequence with the companion actuators so that at all times at least one of the metering blades in each group occupies its extended reference position, and biasing means interposed between the frame of the fountain and each carrier for urging the carrier in the direction of the fountain roller thereby to keep the extended blade on each carrier in contact with the fountain roller to act as a local gauging device for the retracted ones of the blades in the group.

2. An ink fountain comprising, in combination, a frame defining a flat carrier-supporting surface, a fountain roller journaled with respect to the frame and extending the length of said supporting surface, drive means for slowly rotating the fountain roller, a plurality of carriers in the form of rectangular plates spaced side-by-side along such supporting surface and slideable thereon parallel to one another and perpendicular to the roller, the upper surfaces of the carriers lying in a common plane to define a blade-supporting surface, a plurality of metering blades on the blade-supporting surface, the blades being of rectangular shape arranged closely side-by-side to define zonal positions, each of the blades having a metering edge which is presented to the fountain roller, a body of ink above the metering blades and contained by the fountain roller, the metering blades being divided into small groups of equal number with each group being supported on a single one of the carriers, a set of stops interposed between each blade and its carrier, the stops defining (a) an extended reference position in which the presented edges of the blades on the carrier are in alignment and (b) a relatively retracted feeding position in which the blade is retracted a predetermined amount to define a gap for feeding of ink in the zonal position controlled by the blade, each blade having a spring for biasing it forceably into its extended position relative to its carrier, an individual power actuator interposed between each blade and its carrier for retraction of the blade to its feeding position, control means for activating the actuators for periods of time which correspond to the ink requirements of the zonal position, the control means including provision for ensuring that at least one of the actuators in each group is activated in sequence with the companion actuators so that at all times at least one of the metering blades in each group occupies its extended reference position, and a carrier biasing spring interposed between the frame of the fountain and each carrier for urging the carrier in the direction of the fountain roller thereby to keep the extended blade on each carrier in contact with the fountain roller to act as a local gauging device for the retracted ones of the blades in the group.

3. An ink fountain comprising, in combination, a frame defining a flat carrier-supporting surface, a fountain roller journaled with respect to the frame and extending the length of said supporting surface, drive means for slowly rotating the fountain roller, a plurality of carriers in the form of rectangular plates spaced side-by-side along such supporting surface and guided thereon for movement parallel to one another and perpendicular to the roller, the upper surfaces of the carriers lying in a common plane to define a blade-supporting surface, a plurality of metering blades on the blade-supporting surface defining zonal positions, the blades being of rectangular shape arranged closely side-by-side and having a metering edge which is presented to the fountain roller, a body of ink above the metering blades and contained by the fountain roller, the metering blades being divided into small groups of equal number with each group being supported on a single one of the carriers, a set of fixed stops interposed between each blade and its carrier, the stops defining (a) an extended reference position in which the presented edges of the blades on the carrier are in alignment and (b) a relatively retracted feeding position in which the blade is retracted a predetermined amount to define a gap for feeding of ink in the zonal position controlled by the blade, the gap width being the same for all of the blades, each blade having a spring for biasing it forceably into its extended position relative to its carrier, an individual power actuator of the electromagnetic type interposed between each blade and its carrier for retraction of the blade to its feeding position, control means for electrically energizing the actuators for periods of time which correspond to the ink requirements of the zonal position, the control means having means including interlocked circuitry for ensuring that at least one of the actuators in each group is activated in sequence with the companion actuators so that at all times at least one of the metering blades in each group occupies its extended reference position, and a carrier biasing spring interposed between the frame of the fountain and each carrier for urging the carrier in the direction of the fountain roller thereby to keep the extended blade on each carrier in contact with the fountain roller to act as a local gauging device for the retracted ones of the blades in the group.

4. The combination as claimed in claim 1 or in claim 2 or in claim 3 in which three metering blades are supported as a group upon each of the carriers.

5. The combination as claimed in claim 1 or in claim 2 or in claim 3 in which the number of metering blades supported as a group upon each of the carriers lies within the range of two to four, with the width of the carrier being less than the total width of the blades supported thereon.

6. The combination as claimed in claim 1 or in claim 2 or in claim 3 in which the stops are so dimensioned that the relative movement of each metering blade with respect to its carrier is the same.

* * * * *

UNITED STATES PATENT AND TRADEMARK OFFICE

CERTIFICATE OF CORRECTION

PATENT NO. : 4,328,748

DATED : May 11, 1982

INVENTOR(S) : Peter Schramm

It is certified that error appears in the above-identified patent and that said Letters Patent are hereby corrected as shown below:

Col. 1, line 37, change "2628 098" to --2648 098--.

Col. 2, line 7, change "acurately" to --accurately--.

Col. 2, line 17, change "occuring" to --occurring--.

Col. 6, line 24, change "patch of" to --patch or--.

Signed and Sealed this

*Twenty-seventh* Day of *July 1982*

[SEAL]

*Attest:*

GERALD J. MOSSINGHOFF

*Attesting Officer*

*Commissioner of Patents and Trademarks*